US007161541B2

(12) United States Patent
Chen

(10) Patent No.: US 7,161,541 B2
(45) Date of Patent: Jan. 9, 2007

(54) MOBILE TELECOMMUNICATION DEVICE AND PLANAR ANTENNA THEREOF

(75) Inventor: Ming-Feng Chen, Taipei (TW)

(73) Assignee: Asustek Computer Inc., Taipei (TW)

( * ) Notice: Subject to any disclaimer, the term of this patent is extended or adjusted under 35 U.S.C. 154(b) by 0 days.

(21) Appl. No.: 11/211,819

(22) Filed: Aug. 25, 2005

(65) Prior Publication Data

US 2006/0061509 A1 Mar. 23, 2006

(30) Foreign Application Priority Data

Sep. 17, 2004 (TW) ..... 93128170 A

(51) Int. Cl.
*H01Q 1/24* (2006.01)
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,343,208 | B1 | 1/2002 | Ying | 455/90 |
| 6,448,932 | B1 * | 9/2002 | Stoiljkovic et al. | 343/700 MS |
| 6,476,769 | B1 | 11/2002 | Lehtola | 343/702 |
| 6,552,686 | B1 * | 4/2003 | Ollikainen et al. | 343/700 MS |
| 6,650,294 | B1 * | 11/2003 | Ying et al. | 343/700 MS |
| 6,856,285 | B1 * | 2/2005 | Bettin et al. | 343/700 MS |
| 6,950,065 | B1 * | 9/2005 | Ying et al. | 343/700 MS |
| 7,119,743 | B1 * | 10/2006 | Iguchi et al. | 343/700 MS |
| 2005/0007283 | A1 * | 1/2005 | Jo et al. | 343/702 |
| 2006/0152411 | A1 * | 7/2006 | Iguchi et al. | 343/700 MS |

FOREIGN PATENT DOCUMENTS

| | | | |
|---|---|---|---|
| EP | 1 263 079 | A1 | 12/2002 |
| WO | WO 02/078123 | A1 | 10/2002 |
| WO | WO 02/078124 | A1 | 10/2002 |
| WO | WO 2005/043674 | A1 | 5/2005 |

OTHER PUBLICATIONS

"Dual-Frequency Planar Inverted-F Antenna" Liu et al., Oct. 1997, pp. 1451-1458.
"Low-Profile Enhanced-Bandwidth PIFA Antennas for Wireless Communications Packaging" Virga et al., Oct. 1997, pp. 1879-1888.
"A Dial-Band Planar Inverted-F Patch Antenna with a Branch-Line Slit" Hsiao et al., Feb. 2002, pp. 310-312.

(Continued)

*Primary Examiner*—Tan Ho
(74) *Attorney, Agent, or Firm*—Thomas, Kayden, Horstemeyer & Risley

(57) ABSTRACT

A planar antenna. A first plane radiation member, a second plane radiation member, and a third plane radiation member oppose a ground area and provide a first resonant frequency, a second resonant frequency, and a third second resonant frequency, respectively. The first plane radiation member includes a first ground end, a feeding end, and an intermediate portion therebetween. The feeding end inputs signals. The second plane radiation member includes a connecting portion and a first free end extending to one side of the first plane radiation member and separated from the first ground end and feeding end by a first gap. The connecting portion is connected to the intermediate portion. The third plane radiation member includes a second ground end and a third free end surrounding the first and second plane radiation members and separated therefrom by a third gap. The second ground end is connected to the ground area.

28 Claims, 2 Drawing Sheets

OTHER PUBLICATIONS

"Compact PIFA for GSM/DCS/PCS Triple-Band Mobile Phone" Chen et al., 2002, pp. 528-531.

"Dual-Frequency PIFA with a Rolled Radiating Arm for GSM/DCS Operation" Hsiao et al., 2003, pp. 103-106.

* cited by examiner

MOBILE TELECOMMUNICATION DEVICE AND PLANAR ANTENNA THEREOF

BACKGROUND

1. Field of the Invention

The invention relates to a planar antenna, and in particular to a mobile telecommunication device with a built-in planar antenna providing multiple frequency bands.

2. Description of the Prior Art

An antenna is indispensable part of a mobile telecommunication device. A planar inverted-F antenna (PIFA) is commonly built into a mobile telecommunication device. As miniature antennas are commonly built into mobile telecommunication devices, planar inverted-F antennas (PIFA) with EGSM (880 MHz–960 MHz), DCS (1710 MHz–1880 MHZ), and PCS (1850 MHZ–1990 MHz) functions are developed accordingly.

A dual-frequency planar inverted-F antenna is disclosed by Liu (IEEE transaction on Antennas and Propagation, Vol. 45, pages 1451–1458, Oct. 10, 1997). A dual-band planar inverted-F patch antenna with a branch-line slit is disclosed by Hsiao (Microwave and Optical Technology Letters, Vol. 32, pages 310–312, Feb. 4, 2002). A dual-frequency PIFA with a rolled radiating arm for GSM-DCS operation is further disclosed by Hsiao (IEEE Antennas and Propagation Society International Symposium, pages 103–106, 2003).

Moreover, a series of studies regarding enhancement of operating bandwidth of PIFA have been made by Virga and Rahmat-Samii (Low-profile enhanced-bandwidth PIFA antennas for wireless communications packaging, IEEE transaction on Microwave Theory and Techniques, Vol. 45, pages 1879–1888, Oct. 10, 1997).

A PIFA with dual-resonant modes is disclosed by Chen in 2002. The resonant points of the PIFA are at 900 MHz and 1900 MHz covering frequency bands of DCS and PCS. The PIFA can thus be used in triple-band (GSM/DCS/PCS) operation (Compact PIFA for GSM-DCS-PCS triple-band mobile phone, IEEE Antennas and Propagation Society International Symposium, pages 528–531, 2002). Accordingly, by cutting a conducting plane in different manners, planar inverted-F antennas (PIFA) with different electromagnetic characteristics can be created. However, when a triple-band PIFA with accurate resonant points is produced, repeated and complex designs are required. Furthermore, when the triple-band PIFA is applied to different mobile telecommunication devices, repeated and complex adjustments are required.

Hence, there is a need for an improved triple-band PIFA built into a mobile telecommunication device. The profiles and relative positions of radiation members in the triple-band PIFA are adequately designed to accomplish triple-band operation for mobile telecommunication.

SUMMARY

Accordingly, an exemplary embodiment of the invention provides a planar antenna comprising a ground area, a first plane radiation member, a second plane radiation member, and a third plane radiation member. The first plane radiation member opposes the ground area and provides a first resonant frequency. The first plane radiation member comprises a first ground end, a feeding end, and an intermediate portion disposed between the first ground end and the feeding end. The first ground end is connected to the ground area, and the feeding end inputs signals. The second plane radiation member opposes the ground area and comprises a connecting portion and a first free end. The connecting portion is connected to the intermediate portion. The first free end extends to one side of the first plane radiation member and is separated from the first ground end and feeding end by a first gap. The feeding end, intermediate portion, connecting portion and first free end constitute a radiation path providing a second resonant frequency. The third plane radiation member opposes the ground area and provides a third resonant frequency differing from the first and second resonant frequencies. The third plane radiation member comprises a second ground end and a third free end. The second ground end is connected to the ground area. The third free end surrounds the first and second plane radiation members and is separated from the first and second plane radiation members by a third gap.

Another exemplary embodiment of the invention provides a mobile telecommunication device comprising a housing, an antenna base, and a planar antenna. The housing comprises an upper case and a back cover. The antenna base is disposed between the upper case and the back cover and comprises a back surface, a front surface, and a ground area. The back surface faces the back cover, and the front surface faces the upper case. The planar antenna is disposed on the ground area and comprises a first plane radiation member, a second plane radiation member, and a third plane radiation member to emit electromagnetic waves.

In an embodiment of the planar antenna, the second plane radiation member further comprises a second free end diverging from the first free end to the connecting portion and separated from the connecting portion by a second gap.

In an embodiment of the planar antenna, the first plane radiation member, connecting portion and first free end constitute an enclosed area, and the second free end diverging from the first free end extends into the enclosed area.

In an embodiment of the planar antenna, the first plane radiation member is ⊓-shaped, and the first ground end and feeding end are respectively on both sides of the intermediate portion. One side of the first plane radiation member, the connecting portion and first free end constitute an enclosed area, and the second free end diverging from the first free end extends into the enclosed area. The first ground end is disposed between the feeding end and the second free end. The second free end extending toward the connecting portion is separated from the connecting portion by a second gap.

In an embodiment of the planar antenna, the first, second and third plane radiation members are on the same plane. The third resonant frequency exceeds the first resonant frequency, and the first resonant frequency exceeds the second resonant frequency. Preferably, the first resonant frequency is between 1710 MHz and 1880 MHz, the second resonant frequency is between 880 MHz and 960 MHz, and the third resonant frequency is between 1850 MHz and 1990 MHz.

DESCRIPTION OF THE DRAWINGS

The invention can be more fully understood by reading the subsequent detailed description and examples with references made to the accompanying drawings, wherein.

DETAILED DESCRIPTION

Figure 1:
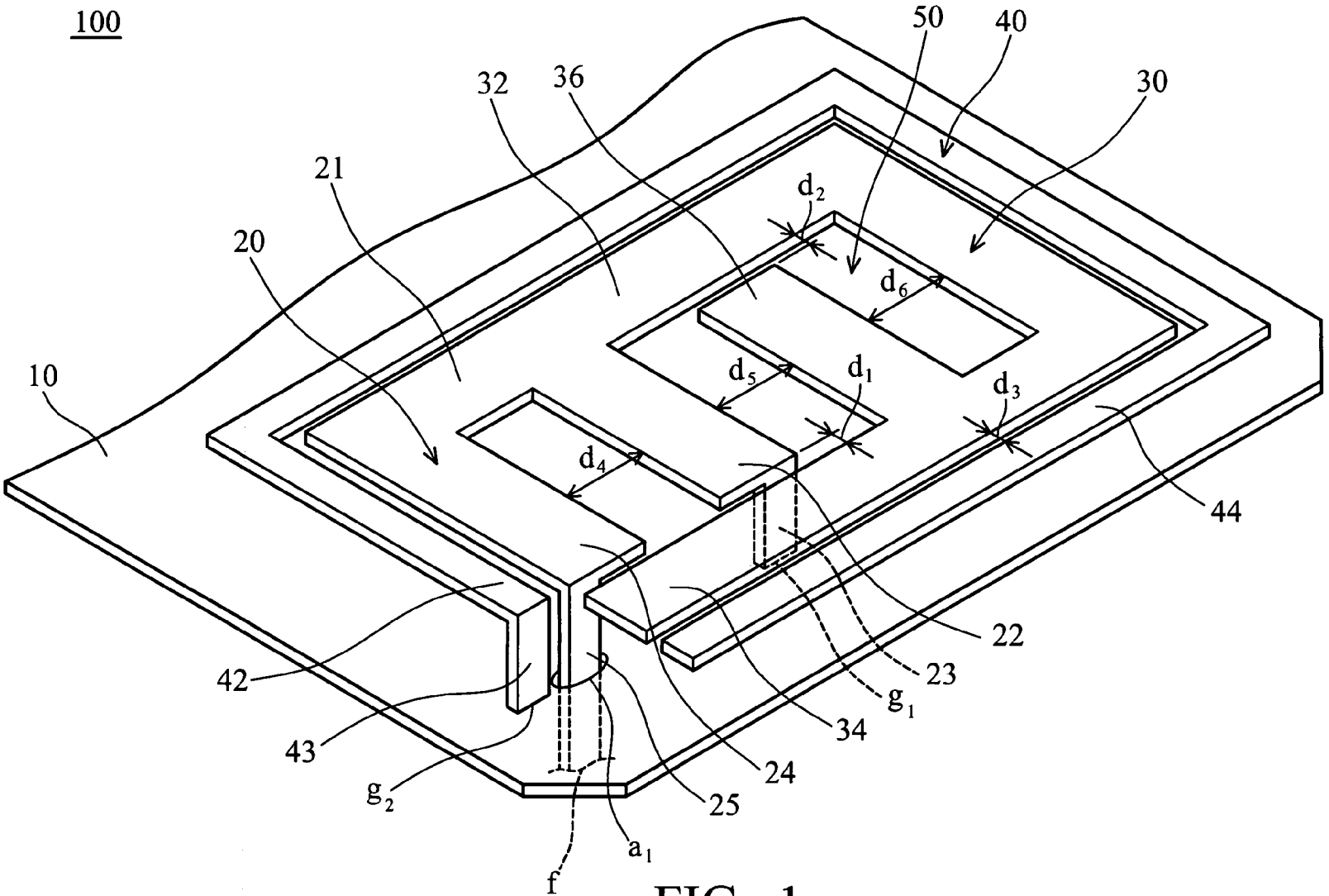
FIG. 1 is a schematic perspective view of the planar antenna of an embodiment of the invention.

Referring to FIG. 1, the planar antenna 100 comprises a ground area 10, a first plane radiation member 20, a second plane radiation member 30, and a third plane radiation member 40. The first plane radiation member 20, second plane radiation member 30, and third plane radiation member 40 are on the same plane. To simplify the drawings, only a part of the ground area 10 is shown in FIG. 1.

The first plane radiation member 20 opposes the ground area 10 and is separated therefrom by a predetermined distance. The first plane radiation member 20 is ⊓-shaped and provides a first resonant frequency. The first plane radiation member 20 comprises a first ground end 22, a feeding end 24, and an intermediate portion 21. The intermediate portion 21 is disposed between the first ground end 22 and the feeding end 24, or the first ground end 22 and feeding end 24 are respectively disposed on both sides of the intermediate portion 21. The first ground end 22 is connected to a ground point $g_1$ of the ground area 10 via a first ground conducting element 23. The feeding end 24 is connected to a feeding conducting element 25. The feeding conducting element 25 passes through a through hole $a_1$ of the ground area 10 and is connected to a feeding point f, to input signals.

The second plane radiation member 30 opposes the ground area 10 and is separated therefrom by a predetermined distance. The second plane radiation member 30 comprises a connecting portion 32, a first free end 34, and a second free end 36. The feeding end 24 and intermediate portion 21 of the first plane radiation member 20 and the connecting portion 32 and first free end 34 of the second plane radiation member 30 constitute a radiation path providing a second resonant frequency. Specifically, the second resonant frequency is less than the first resonant frequency.

Additionally, the connecting portion 32 of the second plane radiation member 30 is connected to the intermediate portion 21 of the first plane radiation member 20. The first free end 34 extends to one side of the first plane radiation member 20 and is separated from the first ground end 22 and feeding end 24 by a first gap $d_1$. The first ground end 22 of the first plane radiation member 20 and the connecting portion 32 and first free end 34 of the second plane radiation member 30 constitute an enclosed area 50. The second free end 36 of the second plane radiation member 30 diverges from the first free end 34, extends into the enclosed area 50, and is parallel to the first ground end 22 and feeding end 24. Accordingly, the first ground end 22 is between the feeding end 24 and the second free end 36. Additionally, the front of second free end 36 is separated from the connecting portion 32 by a second gap $d_2$.

The third plane radiation member 40 opposes the ground area 10 and is separated therefrom by a predetermined distance. The third plane radiation member 40 provides a third resonant frequency differing from the first and second resonant frequencies. Additionally, the third plane radiation member 40 comprises a second ground end 42 and a third free end 44. The second ground end 42 is connected to a ground point $g_2$ of the ground area 10 via a second ground conducting element 43. The third free end 44 surrounds the first plane radiation member 20 and second plane radiation member 30 and is separated therefrom by a third gap $d_3$.

In the planar antenna 100, the third plane radiation member 40 provides a parasitic path and thereby serves as a resonator. The bandwidth of the first plane radiation member 20 is thus enlarged. Accordingly, the third resonant frequency can be greater or less than the first resonant frequency.

In a preferred embodiment of the planar antenna 100, the length of the first, second, and third plane radiation members may approximately be one-fourth of the wavelength at the corresponding resonant point. The first resonant frequency is between 1710 MHz and 1880 MHz (DCS 1800). The second resonant frequency is between 880 MHz and 960 MHz (EGSM 800). The second resonant frequency is between 880 MHz and 960 MHz (PCS 1900). Thus, the planar antenna 100 can be applied to conventional mobile telecommunication systems providing multi-band operation.

Figure 2:
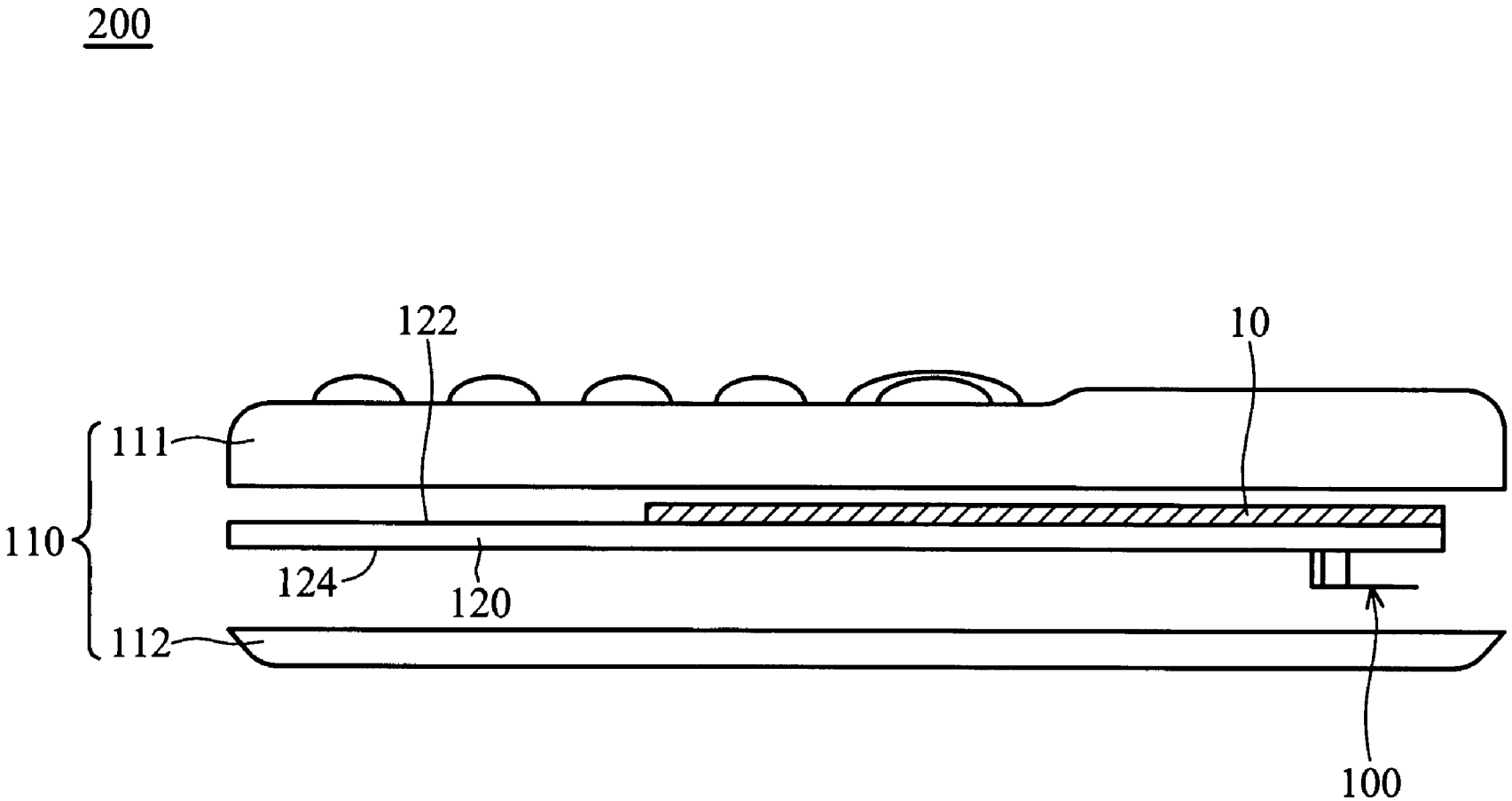
FIG. 2 is a schematic view of the mobile telecommunication device of an embodiment of the invention.

FIG. 2 is a schematic view of the mobile telecommunication device 200 of the invention. The mobile telecommunication device 200 can be, for example, a cellular phone.

As shown in FIG. 2, the mobile telecommunication device 200 comprises a housing 110, an antenna base 120, and a planar antenna 100. The housing 110 comprises an upper case 111 and a back cover 112. The antenna base 120 is disposed between the upper case 111 and the back cover 112 and comprises a back surface 124, a front surface 122, and a ground area 10. The back surface 124 faces the back cover 112, and the front surface 122 faces the upper case 111. Specifically, the ground area 10 is also disposed in the planar antenna 100. The first plane radiation member 20, second plane radiation member 30, and third plane radiation member 40 of the planar antenna 100 is capable of emitting electromagnetic waves of different frequency bands.

The first plane radiation member 20 and second plane radiation member 30 constitute a structure with two opposing inverted-F elements. The first ground end 22 is separated from the feeding end 24 by a fourth gap $d_4$. The second free end 36 is separated from the first ground end 22 by a fifth gap $d_5$. The second free end 36 is separated from an intermediate section between the connecting portion 32 and the first free end 34 by a sixth gap $d_6$. Specifically, when the planar antenna 100 is applied to different cellular phones, the resonant frequencies and gain distribution of the planar antenna 100 deviate due to different antenna bases, ground areas, and housings. The width of the fourth gap $d_4$ (conduction area between the first ground end 22 and the feeding end 24) can be adjusted to alter the point and bandwidth of the first resonant frequency, or the position of the second free end 36 in the enclosed area 50 (widths of the fifth gap $d_5$ and sixth gap $d_6$) can be adjusted to alter the point and bandwidth of the second resonant frequency.

Moreover, the third plane radiation member 40 of the planar antenna 100 serves as a resonator. The bandwidth of the first resonant frequency can be adjusted by adjusting the width of the third plane radiation member 40 or third gap $d_3$. Accordingly, the planar antenna 100 can cover three frequency bands of EGSM, GSM 1800, and GSM 1900, enabling triple-band transmission.

Furthermore, when the profile of the planar antenna 100 remains unchanged, the sizes and widths of the first plane radiation member 20, second plane radiation member 30, and third plane radiation member 40 and gaps therebetween can be adequately adjusted such that the planar antenna 100 can provide other frequency bands and be applied to other telecommunication devices providing dual-band operation, such as IEEE 802.11.b and 802.11.a.

While the invention has been described by way of example and in terms of preferred embodiment, it is to be understood that the invention is not limited thereto. To the contrary, it is intended to cover various modifications and similar arrangements (as would be apparent to those skilled in the art) Therefore, the scope of the appended claims should be accorded the broadest interpretation so as to encompass all such modifications and similar arrangements.

What is claimed is:

1. A planar antenna, comprising:

a ground area;

a first plane radiation member opposing the ground area and providing a first resonant frequency, wherein the first plane radiation member comprises a first ground end, a feeding end, and an intermediate portion disposed between the first ground end and the feeding end, the first ground end is connected to the ground area, and the feeding end inputs signals;

a second plane radiation member opposing the ground area and comprising a connecting portion and a first free end, wherein the connecting portion is connected to the intermediate portion, the first free end extends to one side of the first plane radiation member and is separated from the first ground end and feeding end by a first gap, and the feeding end, intermediate portion, connecting portion and first free end constitute a radiation path providing a second resonant frequency; and a third plane radiation member opposing the ground area and providing a third resonant frequency differing from the first and second resonant frequencies, wherein the third plane radiation member comprises a second ground end and a third free end, the second ground end is connected to the ground area, and the third free end surrounds the first and second plane radiation members and is separated from the first and second plane radiation members by a third gap.

2. The planar antenna as claimed in claim 1, wherein the second plane radiation member further comprises a second free end diverging from the first free end to the connecting portion and separated from the connecting portion by a second gap.

3. The planar antenna as claimed in claim 2, wherein the first plane radiation member, connecting portion and first free end constitute an enclosed area, and the second free end diverging from the first free end extends into the enclosed area.

4. The planar antenna as claimed in claim 2, wherein the first plane radiation member is ⊓-shaped, and the first ground end and feeding end are respectively on both sides of the intermediate portion.

5. The planar antenna as claimed in claim 4, wherein one side of the first plane radiation member, the connecting portion and first free end constitute an enclosed area, and the second free end diverging from the first free end extends into the enclosed area.

6. The planar antenna as claimed in claim 5, wherein the first ground end is disposed between the feeding end and the second free end.

7. The planar antenna as claimed in claim 5, wherein the second free end extending toward the connecting portion is separated from the connecting portion by the second gap.

8. The planar antenna as claimed in claim 1, wherein the first, second and third plane radiation members are on the same plane.

9. The planar antenna as claimed in claim 1, wherein the third resonant frequency exceeds the first resonant frequency, and the first resonant frequency exceeds the second resonant frequency.

10. The planar antenna as claimed in claim 1, wherein the first resonant frequency is between 1710 MHz and 1880 MHz.

11. The planar antenna as claimed in claim 1, wherein the second resonant frequency is between 880 MHz and 960 MHz.

12. The planar antenna as claimed in claim 1, wherein the third resonant frequency is between 1850 MHz and 1990 MHz.

13. A planar antenna, comprising:

a ground area;

a first plane radiation member opposing the ground area and providing a first resonant frequency, wherein the first plane radiation member comprises a first ground end, a feeding end, and an intermediate portion disposed between the first ground end and the feeding end, the first ground end is connected to the ground area, and the feeding end inputs signals; and a second plane radiation member opposing the ground area and comprising a connecting portion, a first free end and a second free end, wherein the connecting portion is connected to the intermediate portion, the first free end extends to one side of the first plane radiation member and is separated from the first ground end and feeding end by a first gap, the second free end diverges from the first free end to the connecting portion and is separated from the connecting portion by a second gap, and the feeding end, intermediate portion, connecting portion and first free end constitute a radiation path providing a second resonant frequency.

14. A planar antenna, comprising:

a ground area;

a first plane radiation member opposing the ground area and providing a first resonant frequency, wherein the first plane radiation member is ⊓-shaped and comprises a first ground end, a feeding end, and an intermediate portion disposed between the first ground end and the feeding end, the first ground end is connected to the ground area, and the feeding end inputs signals; and a second plane radiation member opposing the ground area and comprising a connecting portion and a first free end, wherein the connecting portion is connected to the intermediate portion, the first free end extends to one side of the first plane radiation member and is separated from the first ground end and feeding end by a first gap, and the feeding end, intermediate portion, connecting portion and first free end constitute a radiation path providing a second resonant frequency.

15. A mobile telecommunication device, comprising:

a housing comprising an upper case and a back cover;

an antenna base disposed between the upper case and the back cover and comprising a back surface, a front surface, and a ground area, wherein the back surface faces the back cover, and the front surface faces the upper case; and a planar antenna comprising:

a first plane radiation member opposing the ground area and providing a first resonant frequency, wherein the first plane radiation member comprises a first ground end, a feeding end, and an intermediate portion disposed between the first ground end and the feeding end, the first ground end is connected to the ground area, and the feeding end inputs signals;

a second plane radiation member opposing the ground area and comprising a connecting portion and a first free end, wherein the connecting portion is connected to the intermediate portion, the first free end extends to one side of the first plane radiation member and is separated from the first ground end and feeding end by a first gap, and the feeding end, intermediate portion, connecting portion and first free end constitute a radiation path providing a second resonant frequency; and a third plane radiation member opposing the ground area and providing a third resonant frequency differing from the first and second resonant frequencies, wherein the third plane radiation member comprises a second ground end and a third free end, the second ground end is connected to the ground area, and the third free end surrounds the first and second plane radiation members and is separated from the first and second plane radiation members by a third gap.

16. The mobile telecommunication device as claimed in claim 15, wherein the second plane radiation member further comprises a second free end diverging from the first free end to the connecting portion and separated from the connecting portion by a second gap.

17. The mobile telecommunication device as claimed in claim 16, wherein the first plane radiation member, connecting portion and first free end constitute an enclosed area, and the second free end diverging from the first free end extends into the enclosed area.

18. The mobile telecommunication device as claimed in claim 16, wherein the first plane radiation member is ⊓-shaped, and the first ground end and feeding end are respectively on two sides of the intermediate portion.

19. The mobile telecommunication device as claimed in claim 18, wherein one side of the first plane radiation member, the connecting portion and first free end constitute an enclosed area, and the second free end diverging from the first free end extends into the enclosed area.

20. The mobile telecommunication device as claimed in claim 19, wherein the first ground end is disposed between the feeding end and the second free end.

21. The mobile telecommunication device as claimed in claim 19, wherein the second free end extending toward the connecting portion is separated from the connecting portion by the second gap.

22. The mobile telecommunication device as claimed in claim 15, wherein the first, second and third plane radiation members are on the same plane.

23. The mobile telecommunication device as claimed in claim 15, wherein the third resonant frequency exceeds the first resonant frequency.

24. The mobile telecommunication device as claimed in claim 15, wherein the first resonant frequency is between 1710 MHz and 1880 MHz.

25. The mobile telecommunication device as claimed in claim 15, wherein the second resonant frequency is between 880 MHz and 960 MHz.

26. The mobile telecommunication device as claimed in claim 15, wherein the third resonant frequency is between 1850 MHz and 1990 MHz.

27. A mobile telecommunication device, comprising:

a housing comprising an upper case and a back cover;

an antenna base disposed between the upper case and the back cover and comprising a back surface, a front surface, and a ground area, wherein the back surface faces the back cover, the front surface faces the upper case, and the ground area is disposed on the front surface; and a planar antenna comprising:

a first plane radiation member opposing the ground area and providing a first resonant frequency, wherein the first plane radiation member comprises a first ground end, a feeding end, and an intermediate portion disposed between the first ground end and the feeding end, the first ground end is connected to the ground area, and the feeding end inputs signals; and a second plane radiation member opposing the ground area and comprising a connecting portion, a first free end and a second free end, wherein the connecting portion is connected to the intermediate portion, the first free end extends to one side of the first plane radiation member and is separated from the first ground end and feeding end by a first gap, the second free end diverges from the first free end to the connecting portion and is separated from the connecting portion by a second gap, and the feeding end, intermediate portion, connecting portion and first free end constitute a radiation path providing a second resonant frequency.

28. A mobile telecommunication device, comprising:

a housing comprising an upper case and a back cover;

an antenna base disposed between the upper case and the back cover and comprising a back surface, a front surface, and a ground area, wherein the back surface faces the back cover, and the front surface faces the upper case; and a planar antenna comprising:

a first plane radiation member opposing the ground area and providing a first resonant frequency, wherein the first plane radiation member is ⊓-shaped and comprises a first ground end, a feeding end, and an intermediate portion disposed between the first ground end and the feeding end, the first ground end is connected to the ground area, and the feeding end inputs signals; and a second plane radiation member opposing the ground area and comprising a connecting portion and a first free end, wherein the connecting portion is connected to the intermediate portion, the first free end extends to one side of the first plane radiation member and is separated from the first ground end and feeding end by a first gap, and the feeding end, intermediate portion, connecting portion and first free end constitute a radiation path providing a second resonant frequency.

* * * * *